United States Patent [19]

Sugiura

[11] Patent Number: 4,683,863

[45] Date of Patent: Aug. 4, 1987

[54] EXHAUST GAS RECIRCULATION SYSTEM

[75] Inventor: Katsuhiko Sugiura, Tama, Japan

[73] Assignee: Fuji Jukogyo Kabushiki Kaisha, Tokyo, Japan

[21] Appl. No.: 813,118

[22] Filed: Dec. 24, 1985

[30] Foreign Application Priority Data

Dec. 25, 1984 [JP] Japan ..... 59-277674

[51] Int. Cl.[4] ..... F02M 25/06

[52] U.S. Cl. ..... 123/568

[58] Field of Search ..... 123/568

[56] References Cited

U.S. PATENT DOCUMENTS 4,056,084 11/1977 Baumgartner ..... 123/568
4,057,043 11/1977 Harada ..... 123/568
4,147,494 4/1979 Ando et al. ..... 431/71
4,180,035 12/1979 Saiki et al. ..... 123/568
4,224,909 9/1980 Toyama et al. ..... 123/568
4,484,445 11/1984 Gillbrand ..... 123/568 X

FOREIGN PATENT DOCUMENTS 0035317 3/1978 Japan .

*Primary Examiner*—Willis R. Wolfe, Jr.
*Attorney, Agent, or Firm*—Martin A. Farber

[57] ABSTRACT

Amount of recirculated gases is increased at heavy load on an engine so as to improve the emission control. An EGR valve has a first chamber applied with the pressure at an EGR port in an intake passage and a second chamber applied with the pressure in the intake passage at upstream of a throttle valve so as to open the EGR valve. A control valve is provided to be operated pressures in the intake passage to control the pressure in the second chamber so as to open the EGR valve at heavy load on the engine.

3 Claims, 5 Drawing Figures

EXHAUST GAS RECIRCULATION SYSTEM

BACKGROUND OF THE INVENTION

The present invention relates to an exhaust gas recirculation (EGR) system for an engine of a motor vehicle.

In an EGR system for an engine having an EGR port at the upstream side of a throttle valve at the closed position thereof, the amount of recirculated exhaust gas tends to be excessive when the engine is lightly loaded and inadequate when it is heavily loaded. Such a tendency is remarkable in the EGR system of an engine having a turbocharger.

Japanese Utility Model Laid-Open No. 53-35317 proposes a system wherein the amount of the recirculated exhaust gases is prevented from increasing during light and medium loads of the engine. However, the system has structural defects such as inversion of a diaphragm provided in an EGR valve.

SUMMARY OF THE INVENTION

The object of the present invention is to provide an improved EGR system wherein the above described defect is overcome so that the exhaust gas recirculation is appropriately controlled in accordance with the engine load and speed for a turbocharged engine as well as a natural aspirated engine.

According to the present invention, there is provided an exhaust ga recirculation system for an engine having a throttle valve in an intake passage, comprising, the intake passage having an EGR port provided adjacent to the upstream side of the throttle valve at the closed position thereof, a control port provided at a position at downstream of the throttle valve at the closed position, and a leak port provided at the upstream of the throttle valve, an EGR valve for recirculating exhaust gases to the intake passage, the EGR valve having a diaphragm defining a first chamber applied with the pressure at the EGR port and a second chamber applied with the pressure at the leak port, a valve body connected to the diaphragm for controlling the amount of recirculated gases. The system further comprises a control valve having a diaphragm defining a first control chamber and a second control chamber, and valve means provided on the diaphragm, the first control chamber being applied with the pressure at the EGR port, the second control chamber being applied with the pressure at the control port through a first conduit having an end port and with the pressure at the leak port through a second conduit, the valve means being arranged to open the end port of the first conduit when the difference between pressures in the first and second control chambers exceeds a predetermined value, pressure regulating means for rendering the pressure in the second control chamber lower than the pressure in the second chamber of the EGR valve.

In an aspect of the invention, the valve means comprises a valve plate provided on the diaphragm for closing the end port of the first conduit, and the pressure regulating means comprising orifices provided in the second conduit. The other objects and features of this invention will become understood from the following description with reference to the accompanying drawings.

DETAILED DESCRIPTION OF THE PREFERRED EMBODIMENT

Figure 1:
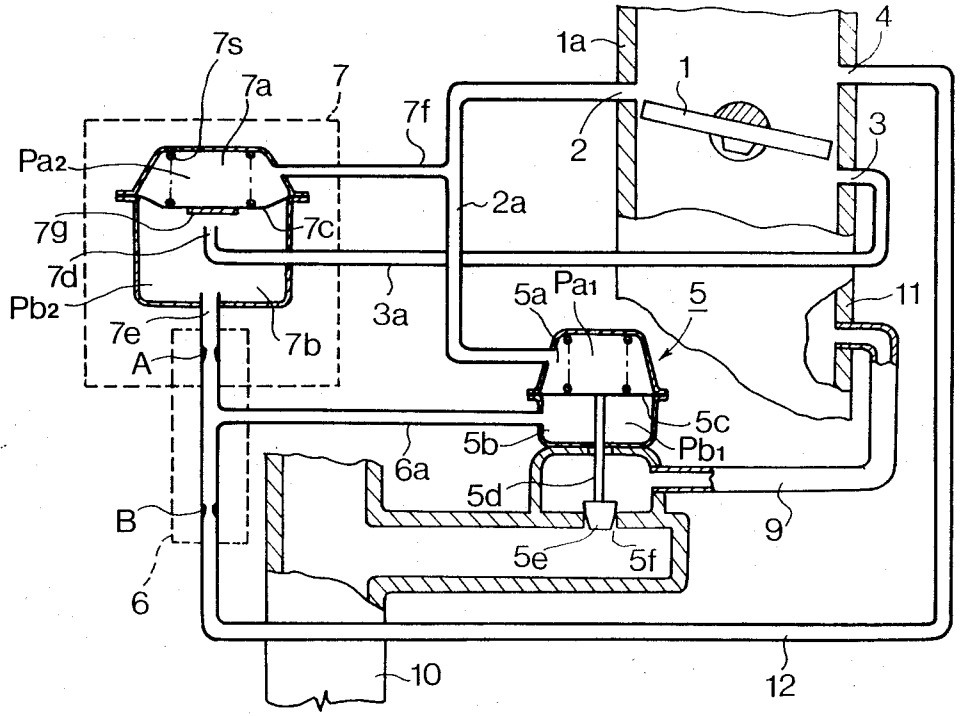
FIG. 1 is a schematic diagram showing an embodiment according to the present invention.

Referring to FIG. 1, a carburetor of an engine is provided with a throttle valve 1 in an intake passage 1*a*, an EGR port 2 positioned just above the upward swinging end of the throttle valve 1 in its closed position, a control port 3 positioned at a certain position (for example about 15° from the closed position) below the downward swinging end, and a leak port 4 positioned at upstream of the throttle valve 1. An EGR valve 5 is provided in a conduit 9 connecting an exhaust manifold 10 with an intake manifold 11 for opening and closing the conduit 9. The EGR valve 5 comprises upper and lower vacuum chambers 5*a* and 5*b* defined by a spring loaded diaphragm 5*c*. The upper vacuum chamber 5*a* is communicated with the EGR port 2 through a conduit 2*a* and the lower vacuum chamber 5*b* with the leak port 4 through a conduit 12 and a pressure regulating means 6. The pressure regulating means comprises orifices A and B provided in the conduit. The lower vacuum chamber 5*b* is applied with the pressure between the orifices A and B. The diaphragm 5*c* is secured to one end of a valve stem 5*d*, the opposite end of which is secured to a conical valve body 5*e*.

The EGR port 2 is also communicated with a pressure control valve 7, which controls the pressure applied to the lower vacuum chamber 5*b* of the EGR valve 5, through the pressure regulating means 6. The pressure control valve 7 comprises upper and lower vacuum chambers 7*a* and 7*b* defined by a spring loaded diaphragm 7*c*. The upper chamber 7*a* is communicated with the EGR port 2 through vacuum conduits 7*f* and 2*a*, and lower vacuum chamber 7*b* is communicated with the regulating means 6 at the upper end thereof through a conduit 7*e*. Inside the chamber 7*b*, a valve plate 7*g* fixed to the diaphragm 7*c* is provided adjacent an end port 7*d* of a vacuum conduit 3*a* connected to the control port 3. A spring 7*s* is provided for urging the diaphragm 7*c* downward, thereby closing the port 7*d*. The port 7*d* is opened when pressure $Pa_2$ in the upper chamber 7*a* is lower than pressure $Pb_2$ in the lower chamber 7*b*. The lower end of the pressure regulating means 6 is communicated with the leak port 4 by a conduit 12.

The operation of the EGR system is as follows. When the throttle valve 1 is closed during idling, the atmospheric pressure is supplied to the vacuum chamber 7*a* of the pressure control valve 7 through conduits 2*a* and 7*f*, and to the vacuum chamber 5*a* of the EGR valve 5 through the conduit 2*a*. Therefore, the pressure $Pa_2$ is higher than the pressure $Pb_2$ which depends on vacuum at the control port 3. Accordingly, the port 7*d* is closed by the valve plate 7*g* of diaphragm 7*c*. Similarly, the pressure $Pa_1$ in the vacuum chamber 5*a* of the EGR valve 5 is higher than the pressure $Pb_1$ in the chamber 5*b*, so that the diaphragm 5*c* is urged downward. Accordingly, the valve body 5*e* is in contact, which causes the valve seat 5*f* to close the recirculation conduit 9.

When the throttle valve is partially opened, the pressure at the EGR port 2 becomes vacuum which is supplied to the chamber 7*a*. When the pressure $Pa_2$ in chamber 7*a* becomes below a predetermined value, the diaphragm 7*c* and therefore the valve plate 7*g* are lifted against the spring 7*s* to open the port 7*d*. Therefore, the pressure at the port 3 is supplied to the lower vacuum chamber 7*b*. When the pressure $Pb_2$ becomes lower than the predetermined value, diaphragm 7*c* and the valve plate 7*g* are downwardly deflected, thereby closing the port 7*d*. Therefore, the pressure control valve 7 is adapted to keep the difference between pressures $Pa_2$ and $Pb_2$ constant. In other words, the difference is the predetermined value of the valve 7, the air in the lower vacuum chamber 7*b* leaks out through the orifices A and B to the leak port 4 to reduce the pressure $Pb_2$. The pressure at the position between the orifices A and B is supplied to the lower vacuum chamber 5*b* of the EGR valve 5. The upper chamber 5*a* is supplied with the vacuum as the EGR port 2 so that the diaphragm is raised against the spring to lift the valve body 5*e* off the valve seat 5*f*. Accordingly, the exhaust gases are recirculated from the exhaust manifold 10 to intake manifold 11 through EGR valve 5 and conduit 9. The lift of the valve body 5*e* depends on the difference between pressures $Pa_1$ and $Pb_1$.

Figure 2:
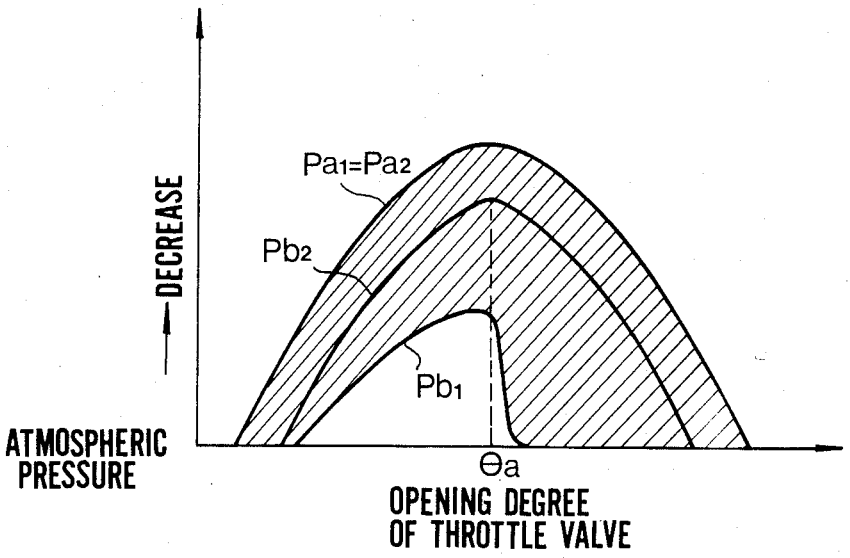
FIG. 2 is a graph showing pressure characteristics of the EGR system of the present invention for an ordinary engine.
Figure 3:
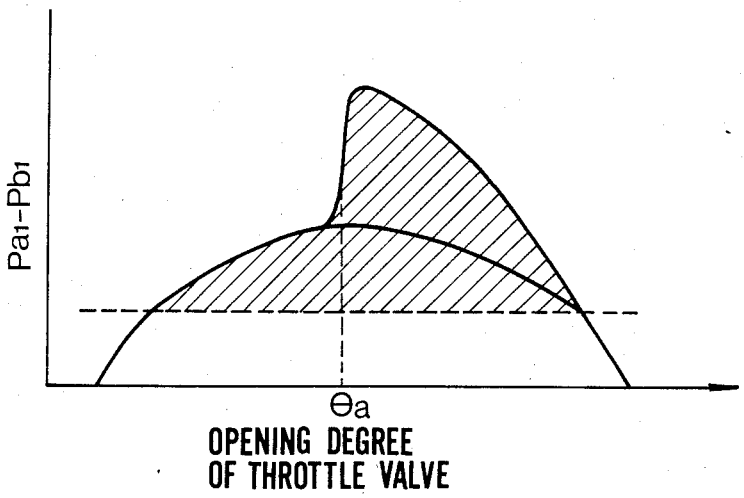
FIG. 3 is a graph showing characteristics of pressure difference in an EGR valve of the EGR system and is desired from FIG. 2.

The characteristics of pressures $Pa_1$, $Pb_1$, $Pa_2$ and $Pb_2$ are shown in FIGS. 2 and 3. The pressure may be expressed as follows;

$$Pa_2 - Pb_2 = \text{const.}$$

$$Pb_1 = Pb_2 \times A/(A+B)$$

where A and B are effective sectional areas of orifices A and B, respectively. Therefore, the pressure $Pb_1$ is determined by the diameters of the orifices A and B.

When the throttle valve is opened below the control port 3, the opening degree is designated by $\theta_a$ in FIG. 2, the pressure $Pb_2$ becomes the atmospheric pressure. Therefore, the difference $(Pa_1 - Pb_1)$ becomes larger as shown in FIG. 3 so that the valve body 5*e*, which is controlled by the pressure difference $(Pa_1 - Pb_1)$, is fully opened to recirculate greater amount of exhaust gases. The hatching zone of FIG. 2 shows the difference $(Pa_1 - Pb_1)$, and that of FIG. 3 shows the lift of the EGR valve. The horizontal dotted line represents the setting pressure of the EGR valve determined by the spring and diaphragm.

Figure 4:
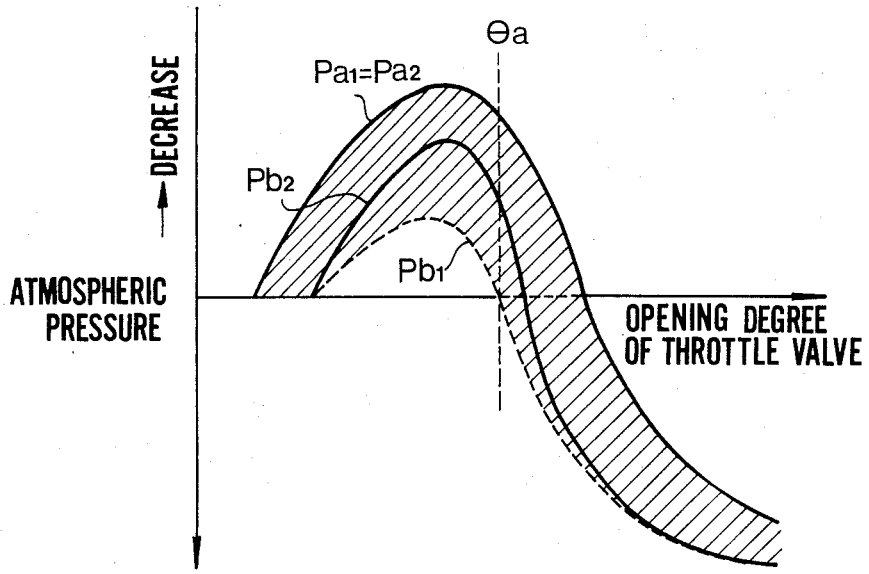
FIG. 4 is a graph showing pressure characteristics of the EGR system for a turbocharged engine.

The characteristics of pressures $Pa_1$, $Pb_1$, $Pa_2$ and $Pb_2$ in an engine having a turbocharger are described in FIG. 4. As the opening degree of the throttle valve 1 increases, the pressure at the leak port 4 and accordingly the pressure $Pb_2$ become higher than the atmospheric pressure in dependency on the increase of supercharging pressure. Therefore, $(Pa_2 - Pb_2)$ is no longer at a constant value determined by the pressure control valve 7 so that $P = Pa_1 - Pb_2$ is increased.

Figure 5:
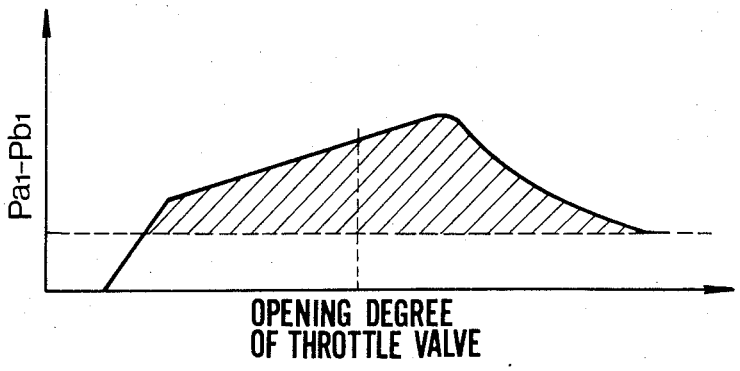
FIG. 5 is a graph showing characteristics of pressure difference in the EGR valve of the turbo charged engine and is derived from FIG. 4.

The pressure $Pb_1$ in the lower vacuum chamber 5*b* depends on the balance between the pressure $Pb_2$ in the lower vacuum chamber 7*b* and the pressure at the upstream side of the throttl valve 1. The characteristics of the pressure difference $(Pa_1 - Pb_1)$ are shown in FIG. 5. Thus, the EGR valve is opened at a wide range of throttle valve opening.

From the foregoing, it will be understood that the EGR system according to the present invention is provided with a pressure control valve to supply an appropriate operating pressure to an EGR valve. Therefore, the rate of the exhaust gas recirculation is controlled in accordance with the driving conditions thereby improving the driveability of the vehicle and effectively lowering the formation of $NO_x$. Furthermore, in an engine provided with a supercharger, the amount of recirculated gas is properly controlled by applying the supercharging pressure depending on engine load.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An exhaust gas recirculation system for an engine having a throttle valve in an intake passage, comprising:

the intake passage having an EGR port provided adjacent to the upstream side of the throttle valve at the closed position thereof, a control port provided at a position at downstream of the throttle valve at the closed position, and a leak port provided at upstream of the throttle valve;

an EGR valve for recirculating exhaust gases to the intake passage, the EGR valve having a diaphragm defining a first chamber applied with the pressure at the EGR port and a second chamber applied with the pressure at the leak port, a valve body connected to the diaphragm for controlling the amount of recirculated gases;

a control valve having a diaphragm defining a first control chamber and a second control chamber, and valve means provided on the diaphragm, the first control chamber being applied with the pressure at the EGR port, the second control chamber being applied with the pressure at the control port through a first conduit having an end port and with the pressure at the leak port through a second conduit, the valve means being arranged to open the end port of the first conduit when the difference between pressures in the first and second control chambers exceeds a predetermined value;

pressure regulating means for rendering the pressure in the second control chamber lower than the pressure in the second chamber of the EGR valve.

2. The system according to claim 1 wherein the valve means comprises a valve plate provided on the diaphragm for closing the end port of the first conduit.

3. The system according to claim 1 wherein the pressure regulating means comprising orifices provided in the second conduit.

* * * * *